US009778605B2

(12) United States Patent
Kabata et al.

(10) Patent No.: US 9,778,605 B2
(45) Date of Patent: Oct. 3, 2017

(54) HEATER LAMP FOR FIXATION, FIXING DEVICE, AND IMAGE FORMING APPARATUS

(71) Applicants: Toshiyuki Kabata, Kanagawa (JP); Hideyuki Yasufuku, Tokyo (JP); Hiroyuki Shimada, Kanagawa (JP); Kazumi Kuwata, Tokyo (JP); Takeshi Shibuya, Shizuoka (JP)

(72) Inventors: Toshiyuki Kabata, Kanagawa (JP); Hideyuki Yasufuku, Tokyo (JP); Hiroyuki Shimada, Kanagawa (JP); Kazumi Kuwata, Tokyo (JP); Takeshi Shibuya, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 314 days.

(21) Appl. No.: 14/282,543

(22) Filed: May 20, 2014

(65) Prior Publication Data

US 2014/0348496 A1 Nov. 27, 2014

(30) Foreign Application Priority Data

May 22, 2013 (JP) ..... 2013-107691
Feb. 10, 2014 (JP) ..... 2014-023144

(51) Int. Cl.
*G03G 15/20* (2006.01)
*H05B 3/00* (2006.01)

(52) U.S. Cl.
CPC ..... *G03G 15/2053* (2013.01); *G03G 15/2064* (2013.01); *H05B 3/0033* (2013.01); *H05B 2203/017* (2013.01); *Y10T 29/49002* (2015.01)

(58) Field of Classification Search
None
See application file for complete search history.

(56) References Cited

U.S. PATENT DOCUMENTS 3,094,642 A * 6/1963 Duval ..... H01K 1/32 313/635
6,501,056 B1 * 12/2002 Hirohata ..... H05B 3/145 219/553

(Continued)

FOREIGN PATENT DOCUMENTS

JP 57-76778 A 5/1982
JP 57-98994 A 6/1982

(Continued)

OTHER PUBLICATIONS

JP 2005-216735 A, Shimonaka, "Lamp Unit," Aug. 2005, partial translation.*

(Continued)

*Primary Examiner* — Joseph M Pelham
(74) *Attorney, Agent, or Firm* — Oblon, McClelland, Maier & Neustadt, L.L.P.

(57) ABSTRACT

A heater lamp for fixation and a method of producing the heater lamp are provided. The heater lamp includes a heat generator and a protective casing to cover the heat generator, in which an amount of carbon in an external surface of the protective casing as detected by an X-ray photoelectron spectroscopic method is equal to or less than 12 atomic %. The method of producing a heater lamp for fixation includes preparing a heat generator; preparing a protective casing to cover the heat generator; and heating the heat generator in an atmosphere containing oxygen gas.

10 Claims, 3 Drawing Sheets

(56) References Cited

U.S. PATENT DOCUMENTS

| | | | | |
|---|---|---|---|---|
| 2002/0096984 | A1* | 7/2002 | Konishi | H01K 1/06 313/25 |
| 2006/0165443 | A1 | 7/2006 | Yoshinaga et al. | |
| 2006/0177232 | A1 | 8/2006 | Ehara et al. | |
| 2006/0257183 | A1 | 11/2006 | Ehara et al. | |
| 2009/0274477 | A1 | 11/2009 | Okamoto et al. | |
| 2009/0274494 | A1 | 11/2009 | Okamoto et al. | |
| 2009/0274495 | A1 | 11/2009 | Okamoto et al. | |
| 2009/0274496 | A1 | 11/2009 | Okamoto et al. | |
| 2009/0274497 | A1 | 11/2009 | Okamoto et al. | |
| 2009/0274498 | A1 | 11/2009 | Okamoto et al. | |
| 2010/0187969 | A1* | 7/2010 | Bunk | H01K 1/10 313/315 |
| 2010/0220462 | A1* | 9/2010 | Nakanishi | C09K 11/616 362/97.2 |
| 2013/0149017 | A1 | 6/2013 | Amita et al. | |
| 2013/0170882 | A1 | 7/2013 | Shimada et al. | |
| 2014/0016975 | A1 | 1/2014 | Shimada et al. | |

FOREIGN PATENT DOCUMENTS

| | | |
|---|---|---|
| JP | 2001-109296 | 4/2001 |
| JP | 2005216735 A * | 8/2005 |
| JP | 2006-003630 | 1/2006 |

OTHER PUBLICATIONS

Office Action issued Jun. 14, 2016 in Japanese Patent Application No. 2014-023144.

* cited by examiner

HEATER LAMP FOR FIXATION, FIXING DEVICE, AND IMAGE FORMING APPARATUS

CROSS-REFERENCE TO RELATED APPLICATIONS

The present application claims priority pursuant to 35 U.S.C. §119(a) from Japanese patent application numbers 2013-107691 and 2014-023144, filed on May 22, 2013 and Feb. 10, 2014, respectively, the entire disclosures of which are incorporated by reference herein.

BACKGROUND

Technical Field

Exemplary aspects of the present disclosure relate to a heater lamp for fixation, method of producing the heater lamp for fixation, a fixing device including the heater lamp for fixation, and an image forming apparatus including the fixing device.

Related Art

Various types of image forming apparatuses employing an electrophotographic method to form images are known, such as copiers, facsimile machines, printers, and multifunctional apparatuses including several of the capabilities of the above devices. In the electrophotographic image forming process, an electrostatic latent image is first formed on the surface of a photoreceptor drum as an image carrier and then developed by toner as a developing agent as a visible image, after which the developed image is then transferred to a recording medium (to be referred to as a sheet, recording sheet, or recording medium) to be carried thereon, and finally the toner image on the recording medium is fixed thereon.

The fixing device in general includes a fixation member the temperature of which is maintained at a certain level by a heating member, and a pressure member contacting the fixing member. The pressure member and the fixing member press against each other to thus form a nip portion through which an unfixed toner image carried on the recording medium is conveyed and fused with pressure and heat, to thus form a visible image thereon. Among various fixing members, there is disclosed a fixing device including a fixing roller with a built-in heater lamp due to its simple structure and reasonable cost.

The fixing device includes a heat roller rotatably disposed and including a built-in tube-shaped heater lamp, and a pressure roller rotatable in close contact with the heat roller, in which a recording medium on which an unfixed toner image is formed is passed between the heat roller and the pressure roller to fix the toner image onto the recording medium. The heat roller includes a permeable member that allows near-infrared rays to pass through and absorbs far-infrared rays. A wavelength conversion reflection film to change the light from the heater lamp to far-infrared rays is disposed on an outer surface of the heater lamp that is not opposite the pressure roller. The disclosed fixing device does not need warming-up time or standby time and can fuse the toner image stably to provide a compact apparatus.

There is provided another fixing device that includes a fixing roller to heat the recording medium and a developing agent on the recording medium with ultra-red rays from the heater, and a pressure roller disposed to contact the fixing device roller with pressure. The fixing roller includes a carbon heater lamp that includes a carbon member as a heat generator. The developing agent on the recording medium is heated by the lamp base tube that serves as a pressure member. The lamp base tube applies pressure to the recording medium for a predetermined time and can reduce the warm-up time of the fixing roller.

On the other hand, with the popularization of image forming apparatuses such as a copier, multifunction apparatus, printer, and the like, the image forming apparatus must also comply with ecological requirements in addition to being compact and inexpensive. In the image forming apparatus employing the electrophotographic process, amount of volatile organic compounds (VOC), ozone, and ultrafine particles that are generated and discharged outside the apparatus in the printing operation should be not greater than a predetermined amount.

SUMMARY

In one embodiment of this disclosure, there is provided a heater lamp for fixation including a heat generator; and a protective casing to cover the heat generator, in which an amount of carbon in an external surface of the protective casing as detected by an X-ray photoelectron spectroscopic method is equal to or less than 12 atomic %.

In one embodiment of this disclosure, there is provided a method of producing a heater lamp for fixation. The method includes preparing a heat generator; preparing a protective casing to cover the heat generator; and heating the heat generator in an atmosphere containing oxygen gas.

These and other objects, features, and advantages of the present invention will become apparent upon consideration of the following description of the preferred embodiments of the present invention when taken in conjunction with the accompanying drawings.

DETAILED DESCRIPTION

Figure 1:
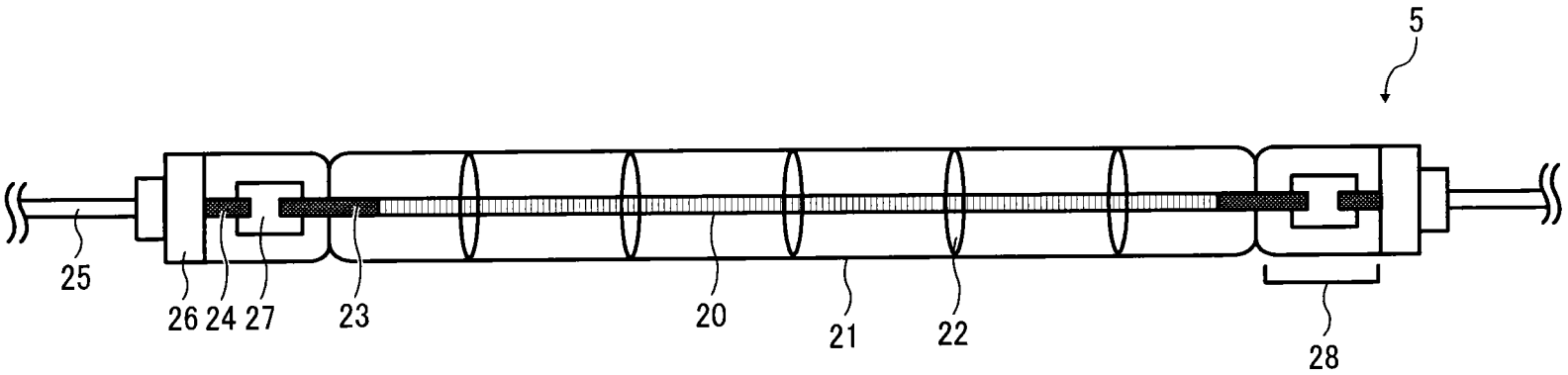
FIG. 1 is a view of a heater lamp for fixation according to an embodiment of the present invention.

In various countries, in Europe in particular, people are conscious about the environment, and German Blue Angel mark, an Eco-label, has been introduced. The Blue Angel mark is awarded to the authorized product meeting the strict environmental criteria. The Japanese Eco mark is established after the example of the Blue Angel mark as a model, and certain criteria are based on the criteria defined by the Blue Angel.

Authorization of the Blue Angel mark represents that the authorized product is recognized as an ecology-conscious product and may greatly affect sales. To receive the Blue Angel mark, various criteria should be fulfilled. In particular, testing related to the criterion of the number of ultrafine particles is very severe.

Specifically, when the ultrafine particles ranging from 5.6 nm to 560 nm generated in the image forming apparatus during printing are measured by a Fast Mobility Particle Sizer (FMPS), the generated number of ultrafine particles should be less than $3.5\times10^{11}$ pieces during 10 minutes. The ultrafine particles may include organic ones and inorganic ones without any discrimination and solid ones and aqueous ones without any discrimination. The magnitude and the number of the ultrafine particles are counted.

Although the ultrafine particles are generated from various parts inside the image forming apparatus, it is known that the generation amount increases greatly only when the fixing device is activated. Then, as to each part constructing the fixing device, generation status of the ultrafine particles was investigated when the fixing device is heated up to the fixing temperature in the actual use environment. As a result, by lighting the heater lamp for fixation alone, the number of ultrafine particles far beyond the certification standard by the Blue Angel mark was obtained.

The main body of the heater lamp for fixation includes a protective casing formed of quartz glass and a built-in electric wire as a heat generator disposed inside the protective casing. Accordingly, there is a low possibility that the ultrafine particles are discharged through the protective casing.

Then, the inventors of the present application thought of another possibility that organic wastes adhered on the external surface of the protective casing is heated and discharged as the ultrafine particles. Then, to investigate this possibility, the inventors tested to remove adhered wastes by ultrasonic cleaning method to clean the external surface of the protective casing using the organic solvent such as n-hexane, cleaning method by the detergent, and physical cleaning using a melamine foam.

As a result, the amount of fine particles generated decreased by 30 to 60% compared to the case before the cleaning, but the number of ultrafine particles was still beyond the certification standard of the Blue Angel mark.

On the other hand, in measurement of the amount of fine particles generated, the inventors tested to repeatedly heat the heater lamp for fixation. As a result, each time heating was done for measurement, the amount of fine particles generated was reduced. The rate of reduction was far greater than that achieved by the cleaning.

Further, the inventors investigated the transition of the particle size distribution of the ultrafine particles. When the above cleaning was not performed, the particle size distribution was in a range from 10 to 40 nm. When heating was repeatedly conducted, the range transits to 5.6 to 10 nm. The particle size distribution of the ultrafine particles generated from the heater lamp for fixation to which the cleaning was done was from the beginning 5.6 to 10 nm.

From those facts, the inventors thought that the ultrafine particles generated from the heater for fixation after cleaning is not the waste adhered externally but from a certain component combined with Si on the surface of the quartz glass in the protective casing. The certain component was decomposed due to heat and separated from the surface of the protective casing.

Then, the inventors analyzed the surface of the protective casing by X-ray photoelectron spectrometer (XPS). It was found that the heater lamp for fixation with a low generation of ultrafine particles during fixation shows very low levels of carbon compared to the heater lamp for fixation that generates many ultrafine particles.

Hereinafter, a heater lamp for fixation according to one aspect of the present disclosure will be described referring to accompanying drawings.

<Heater Lamp for Fixation>

A heater lamp for fixation according an embodiment of the present invention includes a heat generator and a protective casing to cover the heat generator, in which an amount of carbon in an external surface of the protective casing as detected by an X-ray photoelectron spectrometer (hereinafter, to be referred to as the XPS method) is equal to or less than 12 atomic %.

The protective casing is formed of quartz glass and an external surface of the protective casing as a measurement target is a surface layer of the quartz glass. Although the shape of the protective casing according to the present embodiment is, for example, a glass tube, the shape of the protective casing is not limited thereto as long as the protective casing can cover the heat generator. Preferred materials for the heat generator are chrome and tungsten, although tungsten wire is more preferable. An inert gas including nitrogen or argon, or such inert gas mixed with a small amount of iodine and bromine, is sealed within the glass tube.

An example of the heater lamp for fixation according to the present embodiment includes a halogen heater. FIG. 1 illustrates an example of a halogen heater. As illustrated in FIG. 1, the halogen heater 5 includes a filament 20, a glass tube 21, supporting members 22, an internal lead 23, an external lead bar 24, a lead wire 25, a base 26, molybdenum foil 27, and a sealed portion 28.

As illustrated in FIG. 1, a coil-like filament 20 is disposed inside the quartz glass tube 21 along the axial direction of the tube. Both ends of the glass tube 21 are sealed. The filament 20 formed of tungsten, for example, and to generate heat is disposed inside the tube of the glass tube 21 supported by the supporting members 22. Halogen gas is sealed inside the glass tube 21.

The quartz glass tube 21 includes the sealed portion 28 to avoid contact with the air. In the illustrated example in FIG. 1, the sealed portion 28 contains the molybdenum foil 27, which is disposed between the internal lead 23 and the external lead bar 24.

Because the heater lamp for fixation includes the protective casing and an amount of carbon in an external surface of the protective casing as detected by the XPS method exceeds 12 atomic %, the amount of ultrafine particles generated by heating is great, so that an image forming apparatus including the fixing device incorporating such a heater lamp for fixation cannot meet the standard for receiving the Blue Angel mark.

However, when the heater lamp for fixation is measured by itself, even though the generated amount of ultrafine particles exceeds the standard of the Blue Angel mark, because the heater lamp for fixation is disposed inside the heat roller or the fixing roller of the fixing device, the measured amount of the ultrafine particles is applied to the standard for the image forming apparatus as a whole and the Blue Angel mark standard is cleared.

The certification test of the Blue Angel mark is applied to the image forming apparatus as a finished product before selling. To meet the standard for receiving the certification of Blue Angel mark, the amount of carbon in the external surface of the protective casing of the heater lamp for fixation according to the present invention as detected by the XPS method is measured in the unused state (i.e., before actual use), and the amount of fine particles generated is measured in a state in which the heater lamp is incorporated into a newly produced image forming apparatus.

Specifically, the heater lamp for fixation according to the present invention when incorporated newly into the image forming apparatus as a commercial product means that the amount of carbon in the external surface of the protective casing as detected by the XPS method is equal to or lower than 12 atomic % and therefore is subjected to cleaning and heating so that the amount of carbon becomes equal to or lower than 12 atomic %.

Further, after the heater lamp is actually used, the amount of carbon further decreases due to repeated heating in the fixing operation and the amount of fine particles generated further decreases.

However, after starting to operate the image forming apparatus and in a state in which the image forming operation has been continuous, there is a concern that contamination inside the image forming apparatus will grow due to the developing agent, etc., and that generation of ultrafine particles for reasons other than the heater lamp for fixation may occur.

The amount of carbon in the external surface of the protective casing of the heater lamp for fixation detected by the XPS method is preferably equal to or lower than 9 atomic % and is more preferably equal to or lower than 7 atomic %.

As to the carbon in the external surface of the protective casing detected by the XPS method, various binding components can be quantified by waveform separation of C1s spectrum. The amount of C—C and C-Hn binding components in the external surface of the protective casing of the heater lamp for fixation detected by the XPS method is preferably equal to or lower than 10 atomic %. Materials relating to the C—C binding and C-Hn binding are organic contamination adhered on the external surface of the protective casing and this contamination can be removed by a solvent or detergent.

By removing deposits by ultrasonic cleaning to clean the external surface of the protective casing using an organic solvent such as n-hexane, cleaning method by the detergent, and physical cleaning by using a melamine foam, the amount of carbon in the external surface of the protective casing of the heater lamp for fixation detected by the XPS method is reduced to 12 atomic % or less and the amount of fine particles generated in the fixing operation can be reduced.

The fewer C—C and C-Hn binding components in the external surface of the protective casing of the heater lamp for fixation detected by the XPS method becomes, the smaller the amount of fine particles generated in the fixing operation becomes, and its amount is preferably equal to or lower than 5 atomic % and more preferably equal to or lower than 3 atomic %.

The amount of the C—C and C-Hn binding components can be reduced to the lowest possible value of zero atomic % by cleaning the external surface of the protective casing, but the content of carbon cannot be reduced to zero atomic %. As a result of analysis on the type of carbon detected even after the cleaning of the heater lamp for fixation, it is evident that the detected carbon is mainly C—Si binding components.

The C—Si binding is a type of carbon that binds with Si on the topmost layer of the protective casing and is very thinly bound, and therefore, is very difficult to remove by cleaning. However, if the C—Si binding component is heated to a high temperature, the C—Si binding component is oxidized and turns into $SiO_2$ and $CO_2$. The oxidized $SiO_2$ becomes a part of quartz glass that forms the protective casing. Further, a part of oxidized $SiO_2$ is discharged outside and becomes ultrafine particles. In addition, because carbon is removed from the protective casing surface due to oxidization, the ultrafine particles are not generated.

The amount of C—Si binding components in the external surface of the protective casing of the heater lamp for fixation detected by the XPS method is preferably equal to or lower than 8 atomic %. The smaller the amount of C—Si binding components, the more preferable. Specifically, the amount is preferably equal to or lower than 7 atomic % and more preferably equal to or lower than 6 atomic %.

<Method of Producing a Heater Lamp for Fixation>

The method of producing a heater lamp for fixation according to an embodiment of the present invention is first producing a heat generator, and then, the protective casing to cover the heat generator, and performing heating in an atmosphere containing oxygen gas.

In producing the heater lamp for fixation according to the present invention, the amount of carbon (C) in the external surface of the protective casing as detected by the XPS method becomes preferably equal to or lower than 12 atomic %.

Before performing the heating process, the external surface of the protective casing should be cleaned and foreign particles removed. There is no particular limitation on the method of cleaning. However, in the present embodiment, a method in which, after directing compressed air onto the casing, visual inspection is performed to confirm that there is no extraneous matter such as foreign particles is employed. The foreign particles not removed are oxidized through the heating process and removed.

In the heating process, oxygen gas in the atmosphere is necessary to oxidize the C—Si binding component in the external surface of the protective casing to turn into $SiO_2$. The concentration of the oxygen gas in the atmosphere in the heating process is the same as in the normal atmospheric condition, that is, more or less 20 to 22 volume %. However, higher concentration is preferable to accelerate oxidization, so that the heating process is preferably performed under the atmosphere in which the concentration of the oxygen gas is 25 volume % or more. Specifically, the heating process is more preferably performed under the atmosphere in which the oxygen gas concentration is 28 to 50 volume %.

In addition, through the heating process, the surface temperature of the protective casing preferably ranges from 400 to 750 degrees C., and more preferably from 450 to 600 degrees C. If the surface temperature of the protective casing is lower than 400 degrees C., the C—Si binding component is not oxidized and remains, so that the ultrafine particles are generated in the fixing operation. If the surface temperature exceeds 750 degrees C., more energy is required to heat the protective casing and it is disadvantageous in cost and further, the heater lamp for fixation itself is degraded.

Further, the heating process may be performed by increasing the temperature of the atmosphere of the heater lamp for fixation or otherwise, increasing the heater lamp for fixation itself as performed in the fixing operation.

The production method of the heat generator and the protective casing to cover the heat generator is not limited to that described above, and any known method may be used to produce the heater lamp for fixation.

For example, a material for the heat generator is sintered and carbonized to form the heat generator, and the quartz glass material is fused on the heat generator, to thus form the protective casing.

<Fixing Device and Image Forming Apparatus>

The fixing device according to the embodiment of the present invention includes the heater lamp for fixation, the fixing member heated by the heater lamp for fixation, and the pressure member disposed to press at least a part of the fixing member and forming a nip portion between the fixing member and the pressure member itself.

In actual use, a recording medium carrying an unfixed toner image thereon is conveyed to the nip portion and is passed therethrough, so that the unfixed toner image is fixed onto the recording medium.

Specifically, the fixing device according to the present embodiment is the fixing device including the heater lamp for fixation 5, in which the amount of the carbon in the external surface of the protective casing thereof detected by the XPS method is equal to or lower than 12 atomic %.

The fixing device may be configured in either of two ways: (1) the roller fixing method in which the fixing roller including a built-in heater lamp for fixation and the pressure roller pressing the fixing roller are included, and the pressure roller and the fixing roller contact each other with pressure to thus form a fixing nip portion; and (2) the belt fixing method in which the fixing roller disposed opposite the pressure roller, and an endless fixing belt stretched between the fixing roller and the heat roller including the heater lamp for fixation, and the pressure roller and the fixing roller contact with pressure to thus form a nip portion.

An image forming apparatus according to the present embodiment includes the fixing device including the heater lamp for fixation in which the amount of the carbon in the external surface of the protective casing thereof as detected by the XPS method is equal to or lower than 12 atomic %.

Hereinafter, a fixing device and an image forming apparatus according to the present invention will be described referring to accompanying drawings.

Figure 2:
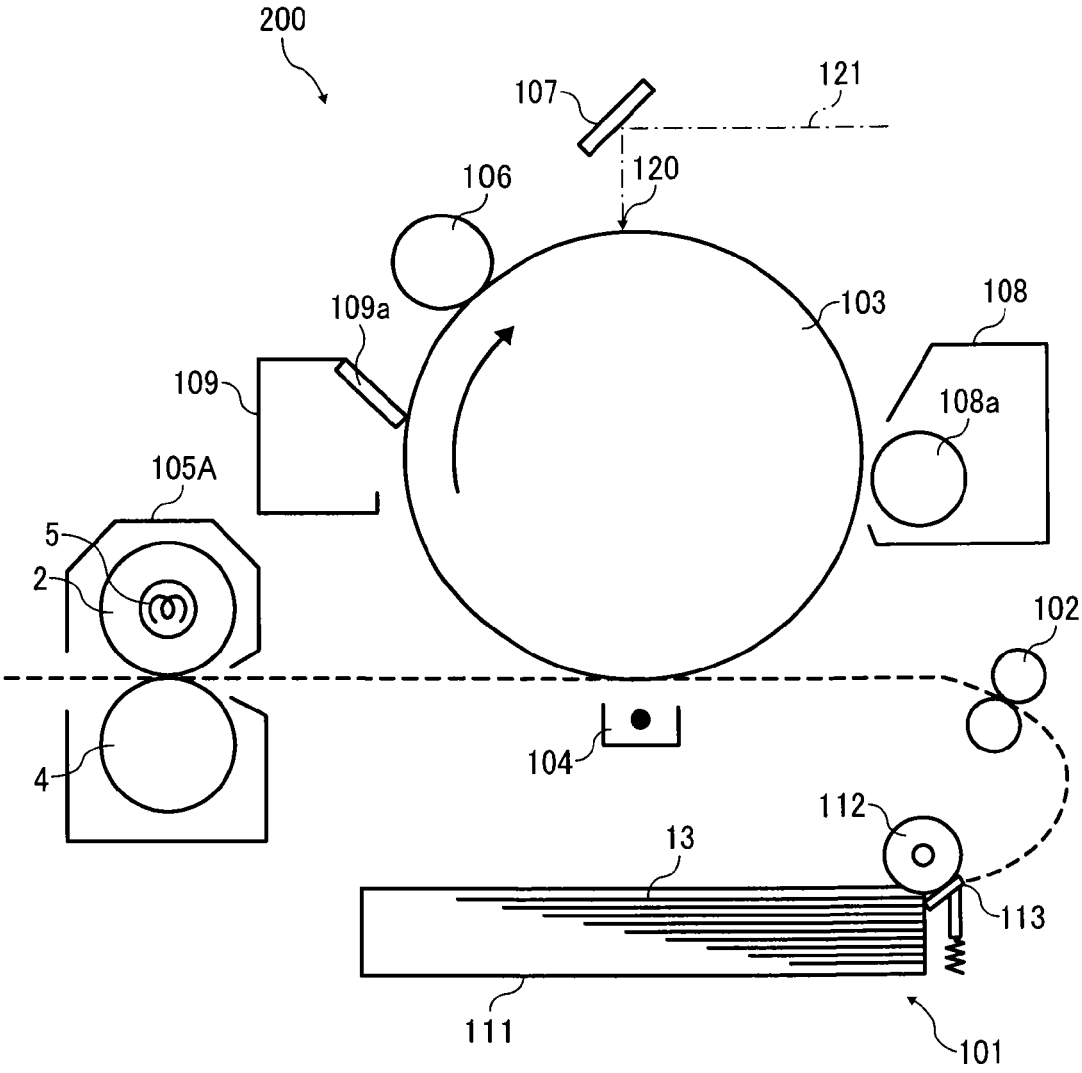
FIG. 2 is a cross-sectional view of an image forming apparatus according to an embodiment of the present invention.

FIG. 2 schematically illustrates one example of an image forming apparatus according to an embodiment of the present invention.

As illustrated in FIG. 2, an image forming apparatus 200 includes a sheet feeder 101, a registration roller pair 102, and a photoreceptor drum 103 as an image carrier, a transfer device 104, and a fixing device 105A.

The fixing device 105A includes a fixing roller 2 and a pressure roller 4. A heater lamp 5 for fixation is disposed inside the fixing roller 2 along an axial direction of the fixing roller 2.

The sheet feeder 101 includes a sheet tray 111, a sheet feed roller 112, and a separator 113. A plurality of transfer sheets or recording media 13 is stacked on the sheet tray 111 and the sheet feed roller 112 conveys each sheet stacked in the sheet tray 11 sequentially from the topmost one.

The transfer sheet 13 conveyed by the sheet feed roller 112 is once suspended at the registration roller pair 102, in which a skew is corrected, and is conveyed to a transfer position N at a timing at which the leading end of the toner image formed on the photoreceptor drum 103 is aligned with the leading end of the transfer sheet 13 in the conveyance direction.

Around the photoreceptor drum 103, a charging roller 106, a mirror 107, a part of an exposure means (not shown), a developing device 108 including a developing roller 108*a*, a transfer device 104, and a cleaning device 109 including a cleaning blade 109*a* are sequentially disposed along the rotation direction (as indicated by an arrow in FIG. 2) of the photoreceptor drum 103.

Exposure light 121 is emitted to an exposure portion 120 on the photoreceptor drum 103 between the charging roller 106 and the developing device 108 via the mirror 107 and scanned. Image formation by the image forming apparatus 200 is performed similarly as in the conventional technology.

Specifically, when the photoreceptor drum 103 starts to rotate, the surface of the photoreceptor drum 103 is charged uniformly by the charging roller 106, the exposure light 121 is emitted to the exposure portion 120 based on image data and scanned, so that a latent image corresponding to the image to be formed by scanning is generated.

This latent image moves to the developing device 108 by the rotation of the photoreceptor drum 103 where the toner is supplied to the latent image, so that the latent image is rendered visible and the toner image is formed.

The toner image formed on the photoreceptor drum 103 is transferred onto the transfer sheet 13 that has entered into the transfer position N at a predetermined timing, via application of transfer bias by the transfer device 104.

The transfer sheet 13 carrying the toner image is conveyed to the fixing device 105A and the toner image is fixed onto the transfer sheet 13 by the fixing device 105A. The transfer sheet 13 is then discharged onto a sheet discharge tray, not shown.

Residual toner remaining on the photoreceptor drum 103 without being transferred at the transfer position N is conveyed along with the rotation of the photoreceptor drum 103 to the cleaning device 109, and is scraped off from the photoreceptor drum 103 by the cleaning blade 109*a* when passing through the cleaning device 109, so that the surface of the photoreceptor drum 103 is cleaned.

Thereafter, the residual potential on the photoreceptor drum 103 is removed by a discharger, not shown, and a process is prepared for a next image forming operation.

The fixing device 105A includes the fixing roller 2 to heat the transfer sheet 13 on which the unfixed toner image is carried, and the pressure roller 4 to contact with pressure the fixing roller 2. The fixing roller 2 and the pressure roller 4 contact each other with pressure to form a press-contact portion, that is, a nip portion. The transfer sheet 13 on which the unfixed toner image is carried is passed through the nip portion, and thus, the unfixed toner is heated and is fixed onto the transfer sheet 13.

FIG. 2 illustrates an example of monochrome image forming apparatus. However, the present invention may be applied to a color image forming apparatus employing an intermediate transfer belt or a tandem-type color image forming apparatus employing a plurality of photoreceptors, developers, and the intermediate transfer belt.

Figure 3:
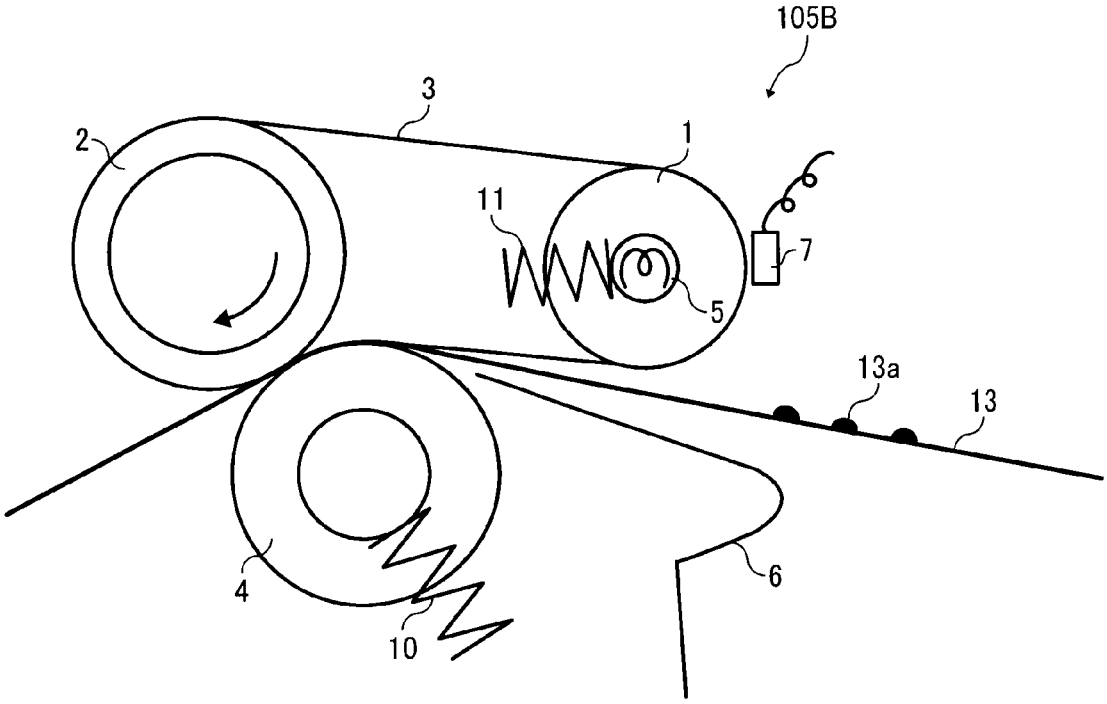
FIG. 3 is a cross-sectional view of a fixing device according to an embodiment of the present invention.

FIG. 3 schematically illustrates one example of a fixing device 105B according to an embodiment of the present invention.

In the example illustrated in FIG. 2, the fixing device 105A includes the fixing roller 2 including the built-in heater lamp 5 and the heater lamp 5 for fixation directly heats the fixing roller 2. However, as in the present embodiment as illustrated in FIG. 3, the fixing device 105B may include a heat roller 1 with a built-in heater lamp 5 for fixation. Specifically, the fixing device 105A may be configured such that the fixing roller 2 includes the built-in heater lamp 5 for fixation as illustrated in FIG. 2 and alternatively such that the heat roller 1 includes the built-in heater lamp 5 for fixation as illustrated in FIG. 3.

The fixing device 105B as illustrated in FIG. 3 includes the heat roller 1 with the built-in heater lamp 5 for fixation, the fixing roller 2, an endless fixing belt 3, the pressure roller 4, an inlet guide plate 6, a thermistor 7 as a temperature detector, a pressure spring 10 as a pressing means, and a tension spring 11 as a tension applying means.

Figure 4:
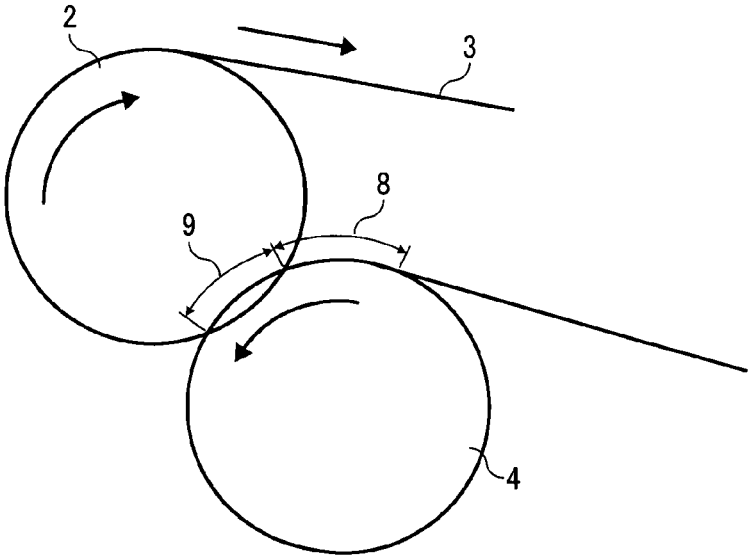
FIG. 4 is a view illustrating a fixing operation in the fixing device in FIG. 3.

FIG. 4 is a view illustrating fixing operation in the fixing device 105B in FIG. 3 and includes a first fixing process portion 8 and a second fixing process portion 9.

The fixing belt 3 is stretched around the heat roller 1 and the fixing roller 2 with a predetermined pressure applied, and the pressure roller 4 is disposed opposite the fixing roller 2 via the fixing belt 3.

The pressure roller 4 presses the fixing roller 2 via the fixing belt 3 in the second fixing process portion 9 and presses the fixing belt 3 without pressure from the fixing roller 2 in the first fixing process portion 8.

To obtain a quick rise time of the fixing device, the heat roller 1 with a built-in heater lamp 5 for fixation is a thin metallic pipe with a small diameter of for example, aluminum, iron, copper, or stainless steel, to thereby have a low thermal capacity.

The fixing belt 3 is heated by the heater lamp 5 for fixation via the heat roller 1. The thermistor 7 detects a surface temperature of the fixing belt 3 at a portion heated by the heat roller 1. Further, the fixing device 105B includes a temperature controller (not shown) to control the heater lamp 5 for fixation so that the surface temperature of the fixing belt 3 is maintained at a predetermined temperature based on the temperature detection signal of the thermistor 7.

A drive source (not shown) drives the fixing roller 2, the heat roller 1, the pressure roller 4, and the fixing belt 3 to rotate.

Further, the transfer sheet 13 carrying unfixed toner 13*a* thereon is conveyed between the fixing belt 3 and the pressure roller 4, the toner 13*a* on the transfer sheet 13 is heated by the fixing belt 3 and is fixed onto the transfer sheet 13.

As illustrated in FIG. 4, in the first fixing process portion 8, pressure for fixation, that is, the pressure between the fixing belt 3 and the pressure roller 4 is set at low so as not to wrinkle the transfer sheet, and the pressure for fixation in the second fixing process portion 9 is set such that desired fixability can be obtained.

The heat roller 1 is pressed by the tension spring 11 and applies tension to the fixing belt 3. The pressure roller 4 is pressed by the pressure spring 10 and applies pressure to the fixing roller 2 via the fixing belt 3.

The pressure for fixation in the first fixing process portion 8 is set by adjusting the tension of the fixing belt 3 by the tension spring 11. The pressure for fixation in the second fixing process portion 9 is set by the pressure spring 10.

The pressure roller 4 may be configured to press the fixing roller 2 via the fixing belt 3 by that the pressure spring 10 presses the fixing roller 2.

In the present embodiment, because the heater lamp 5 for fixation heats the fixing belt 3 via the heat roller 1 that is configured to have a low thermal capacity, a temperature of the fixing belt 3 increases promptly. In addition, because the fixing process includes the first fixing process and the second fixing process and is satisfactorily long (that is, the nip continues 50 nm to 200 nm due to a long nip width), and that the fixing belt 3 includes self-cooling effect (that is, because there is no heat source at the unfixed image surface side in the first and second fixing process portions 8 and 9, the surface of the fixing belt 3 cools in the fixing process), a temperature range optimal for the fixation is obtained and offset allowance is improved.

Further, because the pressure for fixation in the first fixing process 8 into which the transfer sheet 13 enters is set to less than 0.5 kg/cm$^2$ or more preferably less than 0.2 kg/cm$^2$, the transfer sheet 13 smoothly enters into the nip portion between the fixing belt 3 and the pressure roller 4, so that generation rate of the crinkle of the transfer sheet 13 is not worsened than the current condition compared to the heat roller fixing device.

EXAMPLE 1

A heater lamp for fixation produced as a heating means for fixation to be incorporated in the image forming apparatus (color laser printer produced by Ricoh; Model IPSiO SPC830) is prepared. The unused heater lamp for fixation includes a heat generator and a protective casing of quartz glass.

The heater lamp for fixation is soaked into n-hexane solution and is subjected to ultrasonic cleaning for 30 seconds. After the ultrasonic cleaning, the heater lamp for fixation is removed from the n-hexane solution, and the n-hexane component is removed by blowing compressed air against the heater lamp.

Next, after having been left in the test room for seven days, an analysis of the external surface (i.e., quartz glass protective casing surface) of the heater lamp for fixation by the XPS method is done, and the amount of fine particles generated due to heating in the fixation is measured.

A K-Alpha full-automatic X-ray photoelectron spectrometer (produced by Thermo Scientific KK) is used for the analysis of the external surface of the heater lamp for fixation.

The amount of fine particles generated was measured with the test equipment equipped in the certification test laboratory of the German ecology label "Blue Angel mark", in actual use. The amount of fine particles generated was measured for the heater lamp for fixation itself and for the image forming apparatus in which the heater lamp for fixation is incorporated.

The evaluation results are shown in Table 1.

TABLE 1

| | Amount (Atomic %) | | | Generation amount of ultrafine particles (pieces/10 min.) | |
|---|---|---|---|---|---|
| | C | C—C, C-Hn | C—Si | Heater lamp for fixation | Image forming apparatus |
| Example 1 | 12.0 | 9.9 | 2.0 | $6.4 \times 10^{11}$ | $3.4 \times 10^{11}$ |
| Example 2 | 10.1 | 4.7 | 5.1 | $4.7 \times 10^{11}$ | $3.3 \times 10^{11}$ |
| Example 3 | 9.5 | 4.4 | 5.0 | $3.8 \times 10^{11}$ | $3.2 \times 10^{11}$ |
| Comparative example 1 | 24.3 | 23.1 | 1.0 | $1.2 \times 10^{12}$ | $6.1 \times 10^{11}$ |
| Comparative example 2 | 13.7 | 10.9 | 1.9 | $9.1 \times 10^{11}$ | $4.8 \times 10^{11}$ |

As shown in Table 1, the amount of carbon in the external surface of the protective casing as detected by the XPS method was 12 atomic %. In addition, the amount of the C—C binding and C-Hn binding components was 9.9 atomic % and that of the C—Si binding component was 2.0 atomic %.

The amount of fine particles generated from the heater lamp for fixation itself was $6.4\times10^{11}$ pieces/10 min., but the amount of fine particles generated from the image forming apparatus was $3.4\times10^{11}$ pieces/10 min. to meet the certification standard of the Blue Angel mark of $3.5\times10^{11}$ pieces or less during 10 minutes.

EXAMPLE 2

The heater lamp for fixation was soaked in the n-hexane solution, and then, except that the heater lamp was subjected to the ultrasonic cleaning for 120 seconds, the analysis of the external surface of the heater lamp for fixation (i.e., the protective casing surface of the quartz glass) by the XPS method and measurement of the amount of fine particles generated due to heating in the fixation were performed similarly to the case of Example 1.

Table 1 shows an evaluation result.

As shown in Table 1, the amount of carbon in the external surface of the protective casing as detected by the XPS method was 10.1 atomic %. In addition, the amount of the C—C binding and C-Hn binding components was 4.7 atomic % and that of the C—Si binding component was 5.1 atomic %.

The amount of fine particles generated from the heater lamp for fixation itself was $4.7\times10^{11}$ pieces/10 min., and that from the image forming apparatus was $3.3\times10^{11}$ pieces/10 min. to meet the certification standard of the Blue Angle mark of $3.5\times10^{11}$ pieces or less during 10 minutes.

EXAMPLE 3

Except that the heater lamp for fixation was soaked in the n-hexane solution and the heater lamp was subjected to the ultrasonic cleaning for 120 seconds, and further, the heater lamp was soaked in the methylethylketone solution and the ultrasonic cleaning was repeated to the heater lamp for 120 seconds, the analysis of the external surface of the heater lamp for fixation (i.e., the protective casing surface of the quartz glass) by the XPS method and measurement of the amount of fine particles generated due to heating in the fixation were duly performed similarly.

Table 1 shows an evaluation result.

As shown in Table 1, the amount of carbon in the external surface of the protective casing as detected by the XPS method was 9.5 atomic %. In addition, the amount of the C—C binding and C-Hn binding components was 4.4 atomic % and that of the C—Si binding component was 5.0 atomic %.

The amount of fine particles generated was 3.8×1011 pieces/10 min. as for the heater lamp for fixation itself, but that of the image forming apparatus was $3.2\times10^{11}$ pieces/10 min., that meets the requirement of certification standard of the Blue Engel mark of $3.5\times10^{11}$ pieces or less/10 min.

COMPARATIVE EXAMPLE 1

The heater lamp for fixation was not subjected to the ultrasonic cleaning, but the analysis of the external surface of the heater lamp for fixation (i.e., the protective casing surface of the quartz glass) by the XPS method and measurement of the amount of fine particles generated due to heating in the fixation were performed similarly to the case of Example 1.

Table 1 shows an evaluation result.

As shown in Table 1, the amount of carbon in the external surface of the protective casing as detected by the XPS method was 24.3 atomic %. The amount of the C—C binding and C-Hn binding components was 23.1 atomic %, and that of the C—Si binding component was 1.0 atomic %.

The amount of fine particles generated was $1.2\times10^{12}$ pieces/10 min. for the heater lamp for fixation by itself, and the amount of fine particles generated from the image forming apparatus was $6.1\times10^{11}$ pieces/10 min. that does not meet the requirement of certification standard of the Blue Angel mark, that is, $3.5\times10^{11}$ pieces or less/10 min.

COMPARATIVE EXAMPLE 2

Except that the heater lamp for fixation was soaked in the n-hexane solution, and then, the heater lamp was subjected to the ultrasonic cleaning for 10 seconds, the analysis of the external surface of the heater lamp for fixation (i.e., the protective casing surface of the quartz glass) by the XPS method and measurement of the amount of fine particles generated due to heating in the fixation were performed similarly to the case of Example 1.

As shown in Table 1, the amount of carbon in the external surface of the protective casing as detected by the XPS method was 13.7 atomic %. The amount of the C—C binding and C-Hn binding components was 10.9 atomic % and that of the C—Si binding component was 1.9 atomic %.

The amount of fine particles generated from the heater lamp for fixation itself is $9.1\times10^{11}$ pieces/10 min. and that from the image forming apparatus is $4.8\times10^{11}$ pieces/10 min., which does not meet the requirement of certification standard of the Blue Angel mark (that is, less than 3.5×1011 pieces/10 min.).

EXAMPLES 4 TO 6

A heater lamp for fixation produced as a heating means for fixation to be incorporated in the image forming apparatus (color laser printer produced by Ricoh; Model IPSiO SPC830) is prepared. During production process of the heater lamp, the heater lamp is heated under oxygen gas-containing atmosphere and the heater lamp for fixation was obtained. The heater lamp for fixation includes a heat generator and a protective casing of quartz glass.

The heating process was executed by activating the heater lamp, which was activated for 5 minutes in a condition in which the temperature of the external surface of the heater lamp for fixation (that is, the protective casing surface formed of quartz glass) reaches a predetermined value.

The temperature of the external surface is set to 400 degrees C. for Example 4, 500 degrees C. for Example 5, and 600 degrees C. for Example 6.

Next, similarly to Example 1, an analysis of the external surface (i.e., quartz glass protective casing surface) of the heater lamp for fixation by the XPS method is done, and the amount of fine particles generated due to heating in the fixation is measured.

The evaluation results are shown in Table 2.

TABLE 2

| | Amount (Atomic %) | | | Generation amount of ultrafine particles (pieces/10 min.) | |
|---|---|---|---|---|---|
| | C | C—C, C-Hn | C—Si | Heater lamp for fixation | Image forming apparatus |
| Example 4 | 9.3 | 1.1 | 8.0 | $3.4\times10^{11}$ | $2.8\times10^{11}$ |
| Example 5 | 7.5 | .2 | 6.9 | $7.7\times10^{10}$ | $1.4\times10^{11}$ |
| Example 6 | 5.4 | .0 | 4.9 | $6.2\times10^{9}$ | $1.2\times10^{11}$ |
| Example 7 | 4.1 | .0 | 4.0 | $4.0\times10^{9}$ | $1.1\times10^{11}$ |

As shown in Table 2, the amount of carbon in the external surface of the protective casing as detected by the XPS method was less than 12 atomic % in each of Examples 4 to 6. In addition, the amount of either of the C—C binding and C-Hn binding components was less than 10 atomic % and that of the C—Si binding component was less than 9 atomic % in each example.

The amount of fine particles generated in each Example 4 to 6 meets the requirement of less than $3.5\times10^{11}$ pieces/10 min. The amount of fine particles generated from the image forming apparatus meets the requirement of less than $3.5\times10^{11}$ pieces/10 min.

As a result, the generation amount of ultrafine particles due to heating of the heater lamp for fixation is satisfactorily reduced. Further, in Examples 5 and 6, the ultrafine particles discharged from the image forming apparatus are seemed to be discharged from any members other than the heater lamp for fixation.

EXAMPLE 7

A heater lamp for fixation produced as a heating means for fixation to be incorporated in the image forming apparatus (Color laser printer produced by Ricoh; Model IPSiO SPC830) is prepared. During production process of the heater lamp, the heater lamp is heated under oxygen gas-containing atmosphere and the heater lamp for fixation was obtained. The heater lamp for fixation includes a heat generator and a protective casing of quartz glass.

The heating process was executed such that the heater lamp for fixation is placed in a chamber having an atmosphere including 50 mass % of oxygen concentration, and the heater lamp is heated for 5 minutes in a condition in which the temperature of the external surface of the heater lamp for fixation reaches 500 degrees C.

Next, similarly to Example 1, an analysis of the external surface (i.e., quartz glass protective casing surface) of the heater lamp for fixation by the XPS method is done, and the amount of fine particles generated due to heating in the fixation is measured.

Table 2 shows an evaluation result.

As illustrated in Table 2, the amount of carbon in the external surface of the protective casing as detected by the XPS method was 4.1 atomic %. In addition, the amount of the C—C binding and C-Hn binding components was zero atomic % and that of the C—Si binding component was 4.0 atomic %.

The amount of fine particles generated from the heater lamp for fixation itself is $4.0\times10^{9}$ pieces/10 min. and that from the image forming apparatus is $1.1\times10^{11}$ pieces/10 min., which meets the requirement of certification standard of the Blue Angel mark (that is, $3.5\times10^{11}$ pieces or less/10 min.).

As a result, the generation amount of ultrafine particles due to heating of the heater lamp for fixation is satisfactorily reduced. Further, the ultrafine particles discharged from the image forming apparatus are seemed to be discharged from any members other than the heater lamp for fixation.

Additional modifications and variations of the present invention are possible in light of the above teachings. It is therefore to be understood that, within the scope of the appended claims, the invention may be practiced other than as specifically described herein.

What is claimed is:

1. A heater lamp for fixation comprising:

a heat generator; and a protective casing formed of quartz glass to cover the heat generator, wherein an amount of carbon in an external surface of the protective casing, which is a quartz glass, as detected by an X-ray photoelectron spectroscopic method in a new product state prior to use of the heater lamp is not less than 4.1 atomic % and is not larger than 12 atomic %, wherein an amount of C—Si binding component in the external surface of the protective casing of the heater lamp for fixation as detected by the X-ray photoelectron spectroscopic method is from 2.0 atomic % to 8.0 atomic %.

2. The heater lamp for fixation as claimed in claim 1, wherein an amount of C—C binding and C-Hn binding components in the external surface of the protective casing of the heater lamp for fixation as detected by the X-ray photoelectron spectroscopic method is equal to or lower than 10 atomic %.

3. A fixing device comprising:

a heater lamp for fixation as claimed in claim 1;

a fixing member heated by the heater lamp for fixation; and a pressure member disposed to press at least a part of the fixing member and forming a nip portion between the fixing member and the pressure member, wherein the fixing member fixes an unfixed toner image on a recording medium conveyed to and passed through the nip portion.

4. A method of producing a heater lamp for fixation that includes a heat generator and a protective casing to cover the heat generator, comprising:

preparing a protective casing formed of quartz glass to cover the heat generator; and generating an amount of carbon in an external surface of the protective casing, which is a quartz glass, as detected by an X-ray photoelectron spectroscopic method in a new product state following a heating or cleaning step that is not less than 4.1 atomic % and is not larger than 12 atomic %, wherein an amount of C—Si binding component in the external surface of the protective casing of the heater lamp for fixation as detected by the X-ray photoelectron spectroscopic method is from 2.0 atomic % to 8.0 atomic %.

5. The method of producing a heater lamp for fixation as claimed in claim 4, wherein the generating includes heating the heater lamp such that the heating is performed in an atmosphere containing oxygen gas with a concentration of 25 volume % or more.

6. The method of producing a heater lamp for fixation as claimed in claim 4, wherein the generating includes heating the heater lamp such that in the heating, surface temperature of the protective casing reaches 400 to 750 degrees C.

7. A fixing device comprising:

a heater lamp for fixation produced by the method as claimed in claim 4;

a fixing member heated by the heater lamp for fixation; and a pressure member disposed to press at least a part of the fixing member and forming a nip portion between the fixing member and the pressure member;

wherein the fixing member fixes an unfixed toner image on a recording medium conveyed to and passed through the nip portion.

8. An image forming apparatus comprising a fixing device as claimed in claim 3.

9. A method of producing a fixing device comprising:

producing a heater lamp for fixation as claimed in claim 4.

10. A method of producing an image forming apparatus comprising:

producing a heater lamp for fixation as claimed in claim 4.

* * * * *